US009316036B2

(12) United States Patent
Collene et al.

(10) Patent No.: US 9,316,036 B2
(45) Date of Patent: Apr. 19, 2016

(54) APPLIANCE HINGE COUNTERBALANCE ASSEMBLY WITH SNUBBER

(71) Applicant: Mansfield Engineered Components, Inc., Mansfield, OH (US)

(72) Inventors: James J. Collene, Bucyrus, OH (US); Brian White, Shelby, OH (US)

(73) Assignee: Mansfield Engineered Components, Inc., Mansfield, OH (US)

( * ) Notice: Subject to any disclaimer, the term of this patent is extended or adjusted under 35 U.S.C. 154(b) by 48 days.

(21) Appl. No.: 14/283,747

(22) Filed: May 21, 2014

(65) Prior Publication Data

US 2014/0345082 A1 Nov. 27, 2014

Related U.S. Application Data

(60) Provisional application No. 61/826,674, filed on May 23, 2013.

(51) Int. Cl.
*E05F 1/10* (2006.01)
*E05F 1/12* (2006.01)
(Continued)

(52) U.S. Cl.
CPC ..... *E05F 1/1058* (2013.01); *E05F 1/1075* (2013.01); *E05F 1/1261* (2013.01); *E05F 1/1276* (2013.01); *E05F 5/08* (2013.01); *E05F 5/10* (2013.01); *E05F 3/20* (2013.01); *E05Y 2201/00* (2013.01); *E05Y 2201/20* (2013.01); *E05Y 2201/264* (2013.01); *E05Y 2201/638* (2013.01); *E05Y 2201/686* (2013.01); *E05Y 2900/312* (2013.01); *Y10T 16/2788* (2015.01);
(Continued)

(58) Field of Classification Search
CPC ..... E05F 1/1058; E05F 1/1075; E05F 1/1261; E05F 1/1276; E05F 5/06; E05F 5/08; E05F 5/10; E05F 3/20; Y10T 16/538; Y10T 16/5381; Y10T 16/53822; Y10T 16/5383; Y10T 16/53834; Y10T 16/53835; Y10T 16/53885; Y10T 16/2788; Y10T 16/2793; Y10T 16/2796
See application file for complete search history.

(56) References Cited

U.S. PATENT DOCUMENTS 1,634,358 A 7/1927 Hobson
2,173,422 A 9/1939 Lucas
(Continued)

FOREIGN PATENT DOCUMENTS

EP 0 149 937 12/1984

*Primary Examiner* — Jeffrey O Brien
(74) *Attorney, Agent, or Firm* — Fay Sharpe LLP

(57) ABSTRACT

A counterbalance assembly for an appliance hinge has a base including first and second spaced-apart side walls and a transverse face wall. A channel is located between the first and second side walls. First and second notch portions are respectively located in the first and second side walls. A rotating cam is supported on the base and has a camshaft that extends between the side walls and that is adapted for rotation about an axis of rotation, a first end located in the first notch portion and a second end located in the second notch portion. A biasing spring has an inner end engaged with the base and an outer end spaced from the base. A spring rod includes an outer end operatively coupled to the spring and an inner end operatively coupled to the lever. The lever also pivotally connects to the lobe of the cam. A damper assembly is connected to the base and having a piston which is moved between a first position and a second position by the lever contacting the piston. The piston in turn compresses fluid in the damper assembly thus dampening movement of the lid hinge.

12 Claims, 17 Drawing Sheets

(51) Int. Cl.
*E05F 5/08* (2006.01)
*E05F 5/10* (2006.01)
*E05F 3/20* (2006.01)

(52) U.S. Cl.
CPC ..... *Y10T 16/5383* (2015.01); *Y10T 16/5387* (2015.01); *Y10T 16/5388* (2015.01); *Y10T 16/53834* (2015.01)

(56) References Cited

U.S. PATENT DOCUMENTS 2,198,346 A * 4/1940 Little ..... F24C 15/023 126/191
2,479,437 A * 8/1949 Trygve ..... E05F 1/1276 16/289
3,256,554 A * 6/1966 Turner ..... E05F 1/1261 16/273
3,737,947 A * 6/1973 Little ..... E05F 1/1261 16/290
3,749,080 A 7/1973 Kleinhenn
4,269,165 A 5/1981 Wrotny et al.
4,429,494 A * 2/1984 Kornerup ..... E05F 1/1075 49/346
4,658,473 A 4/1987 Schema
5,937,481 A * 8/1999 Faringosi ..... F24C 15/023 126/191
6,397,836 B1 6/2002 Pelletier et al.
6,442,799 B1 9/2002 Duarte et al.
6,637,319 B1 10/2003 Vanini et al.
6,779,856 B2 * 8/2004 Hornberger ..... E05F 17/004 312/295
7,243,396 B2 7/2007 Vanini
7,676,888 B2 * 3/2010 Vanini ..... E05F 5/10 16/277
7,937,807 B2 * 5/2011 Bereznai ..... E05F 5/10 16/82
8,096,455 B2 * 1/2012 Viklund ..... B60R 9/055 224/328
8,250,706 B2 * 8/2012 Vanini ..... E05F 1/1261 16/277
8,266,765 B2 * 9/2012 Donoho ..... E05F 1/1276 16/286
8,443,489 B2 5/2013 Sir Louis
8,683,653 B2 * 4/2014 Bettinzoli ..... E05F 1/1261 16/286
8,991,010 B2 * 3/2015 Brunnmayr ..... E05F 5/006 16/319
9,080,365 B2 * 7/2015 Collene ..... E05F 1/1261
9,169,681 B2 * 10/2015 Cooper ..... E05D 7/0009
9,181,737 B1 * 11/2015 Kadus ..... E05F 1/1261
9,181,741 B2 * 11/2015 Bettinzoli ..... E05F 1/1261
2006/0032019 A1 2/2006 Kistner et al.
2006/0053589 A1 3/2006 Vanini
2009/0064458 A1 3/2009 Vanini
2011/0094056 A1 * 4/2011 Lautenschlager ..... E05F 5/02 16/84
2011/0146654 A1 6/2011 Mudbasal et al.
2011/0298349 A1 * 12/2011 Sutterlutti ..... E05F 5/006 312/326

* cited by examiner

APPLIANCE HINGE COUNTERBALANCE ASSEMBLY WITH SNUBBER

CLAIM OF PRIORITY

This application claims priority from and benefit of the filing date of U.S. Provisional Patent Application Ser. No. 61/826,674, filed on May 23, 2013, and the entire disclosure of the provisional application is hereby expressly incorporated by reference into the present specification.

BACKGROUND OF THE DISCLOSURE

Hinges for top-loading appliances such as washing machines and dryers may include or be operatively connected to a counterbalance assembly that provides a desired counterbalance effect such that the lid/door requires no more than a select amount of force to open, stays open without external support when fully opened, self-closes by gravity without harsh slamming against the appliance body when the lid/door is moved to a select partially closed position, and remains closed during normal operating conditions of the appliance. The counterbalance assembly must fit in a limited area and be designed to operate even after prolonged and repeated exposure to water, soap, bleach, heat, etc. A need has been identified for a new and improved appliance lid/door hinge counterbalance assembly that meets the above-noted design requirements while providing structural and/or functional advantages over known designs.

SUMMARY OF THE DISCLOSURE

In accordance with one aspect of the present disclosure, a counterbalance assembly for an appliance hinge includes a base including first and second spaced-apart side walls and a transverse face wall. The base includes: (i) a channel located between the first and second side walls; and, (ii) a notch comprising first and second notch portions respectively located in said first and second side walls. A rotating cam is supported on the base. The cam includes: (i) a camshaft that extends between the side walls and that is adapted for rotation about an axis of rotation, with a first end of the camshaft located in the first notch portion and a second end of the camshaft located in the second notch portion; and, (ii) a lobe that projects from the camshaft. The counterbalance assembly includes a biasing spring that comprises an inner end engaged with the base and an outer end spaced from the base. The spring is located outside the channel. A spring rod includes an outer end operatively coupled to the spring and an inner end operatively coupled to the lobe of the cam such that the spring biases the spring rod to an extended position. In accordance with another aspect of the disclosure, a snubber or damper assembly is used to provide additional damping to the counterbalance assembly.

In accordance with another aspect of the disclosure, a counterbalance assembly for an appliance hinge has a base including first and second spaced-apart side walls and a transverse face wall, the base including: (i) a channel located between the first and second side walls; and, (ii) first and second slot portions respectively located in the first and second side walls. A rotating cam is supported on the base and cam includes: a camshaft that extends between the side walls and that is adapted for rotation about an axis of rotation. The camshaft comprises a first end located in the first slot portion and a second end located in the second slot portion; and a lobe that projects from the camshaft. A biasing spring has an inner end engaged with the base and an outer end spaced from the base. The spring is also located outside the channel. A spring rod has an outer end operatively coupled to the spring and an inner end operatively coupled to the lobe of the cam such that the spring biases the spring rod to an extended position. A damper assembly includes a lever or link pivotably connected to the spring rod and the lobe of the cam and a piston assembly connected to the base wherein a portion of the piston is moved by the lever between two positions corresponding to lid open and lid closed positions.

Other aspects of the disclosure will be apparent upon a reading and understanding of the following detailed description.

DETAILED DESCRIPTION OF THE DISCLOSURE

Figure 1:
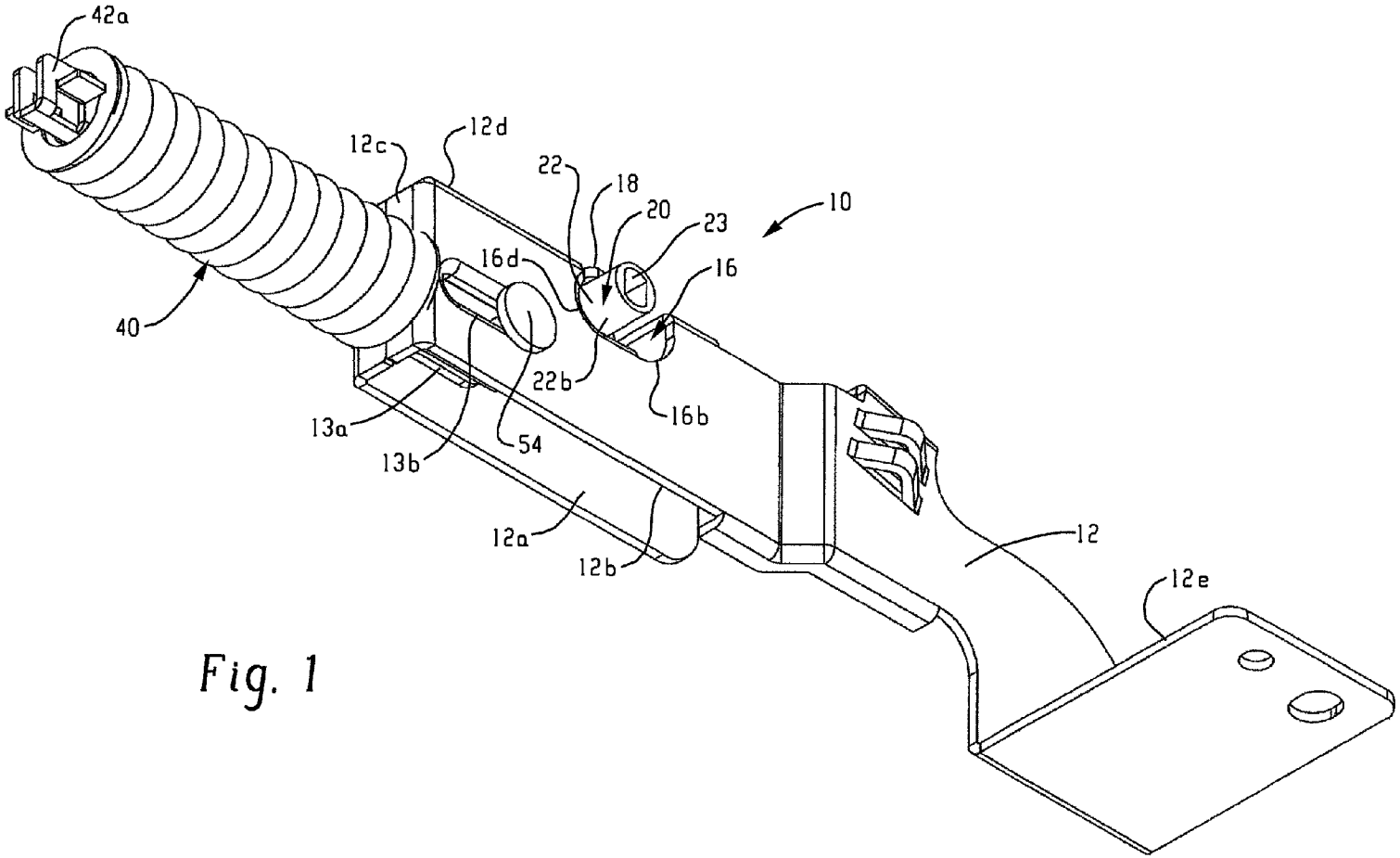
FIGS. 1 and 2 are first and second isometric views of an appliance hinge counterbalance assembly formed in accordance with a first aspect of the present disclosure, with the counterbalance assembly shown in a first operative position corresponding to a lid/door of the appliance being closed.
Figure 2:
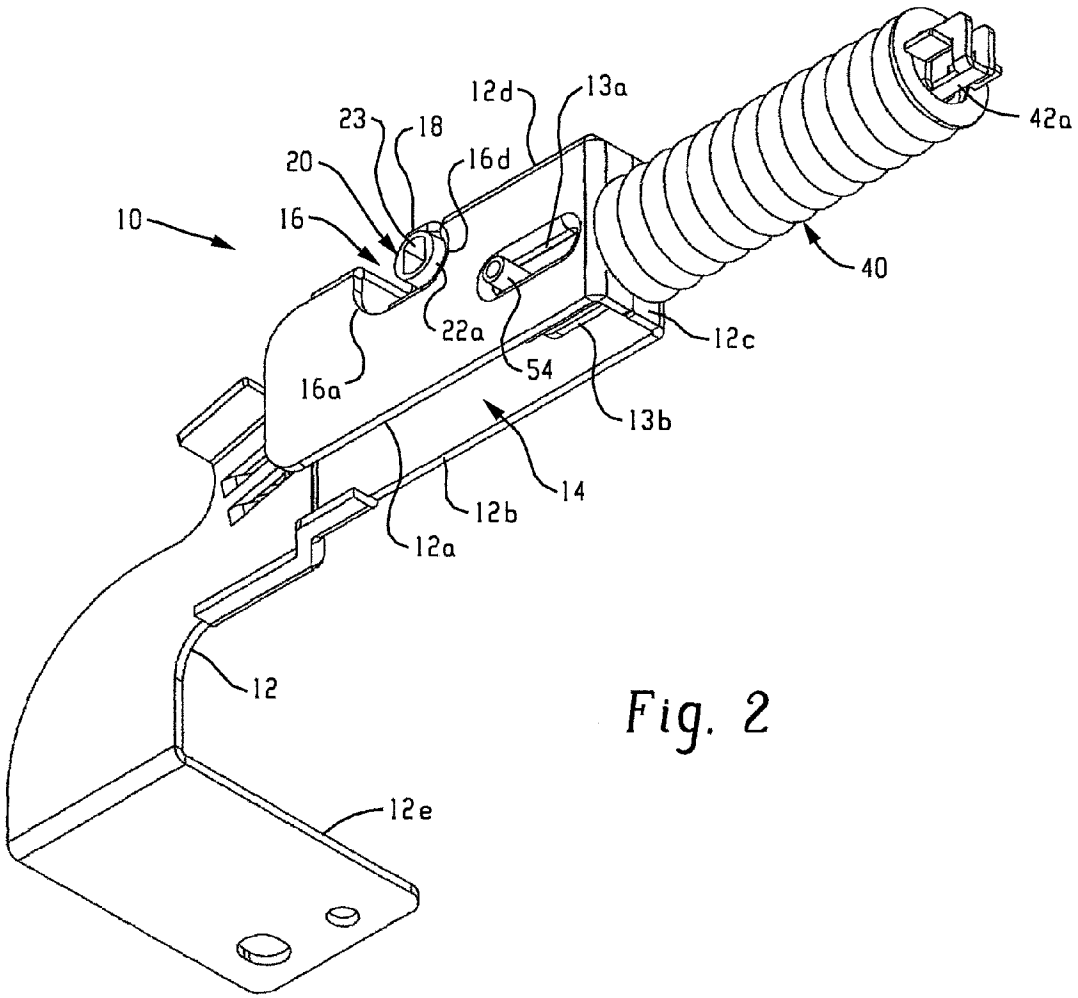

Referring to FIGS. 1-4A, a counterbalance assembly 10 is particularly adapted for operative connection to an associated hinge arm that pivotally secures an appliance lid/door to an appliance body. For example, the counterbalance assembly 10 is adapted for operative connection to a hinge arm used for pivotally securing a lid/door of a top-loading washing machine or dryer to the body of the washing machine or dryer.

In accordance with one aspect of the disclosure, the counterbalance assembly 10 comprises a base 12 defined from a one-piece metal stamping or a multi-piece assembly of metal or other components or other like structure. The base 12 includes first and second longitudinally extending, parallel and spaced-apart side walls 12*a*, 12*b* that typically lie in respective vertical planes when the counterbalance assembly 10 is operatively connected to a washer or other top-loading appliance. A channel 14 is defined between the side walls 12*a*, 12*b* and is closed at one end by a transverse face wall 12*c*. The base 12 also includes a top wall 12*d* that extends between the side walls 12*a*, 12*b*. The base 12 further includes at least one mounting tab 12*e* or other mounting structure adapted to be secured to an appliance body using one or more fasteners such as screws or rivets, or by a weld or other means.

A rotating cam 20 is operably supported on the base 12 and includes a cylindrical camshaft 22 that extends between the side walls 12*a*, 12*b* through the channel 14 and that is adapted for rotation about its longitudinal axis of rotation X (FIG. 3) that extends transverse to the side walls 12*a*, 12*b*. More particularly, the base 12 defines a notch 16 that opens in the top wall 12*d* and the side walls 12*a*, 12*b*. The notch 16 comprises first and second notch portions 16*a*, 16*b* defined respectively in the first and second side walls 12*a*, 12*b*. First and second opposite ends 22*a*, 22*b* of the camshaft 22 are rotatably supported by the first and second notch portions 16*a*, 16*b*, respectively. The top wall 12*d* includes a keeper tab 18 (see also FIG. 4) that projects into the notch 16 so that a dwell point 16*d* for the cam shaft 22 is defined in the notch 16. The keeper tab 18 captures the first and second camshaft ends 22*a*, 22*b* respectively in the first and second notch portions 16*a*, 16*b* so that when the camshaft is seated in the notch dwell point 16*d*, the camshaft 22 is prevented from escaping the notch 16 and helps form the dwell point for the cam to rotate in during normal operation of the counterbalance assembly.

At least one or both opposite ends 22*a*, 22*b* of the camshaft 22 are adapted to be connected to an associated wire-form or other associated appliance lid/door mounting hinge arm 30 (shown in broken lines in FIG. 3) such that the hinge arm 30 and camshaft 22 rotate together on the axis of rotation X. The wire-form or other appliance lid/door mounting hinge arm 30 can alternatively be provided as part of the counterbalance assembly 10. As shown herein, the hinge arm 30 is supplied separately (e.g., as part of the associated appliance). The hinge arm 30 is adapted for connection to an appliance lid/door using fasteners or other means. In the illustrated embodiment, the opposite ends 22*a*, 22*b* of the camshaft 22 include respective non-circular recesses 23 that are adapted for close sliding insertion of a mating non-circular portion of the associated hinge arm 30 in a non-rotatable or keyed manner, but other connections between the hinge mounting arm 30 and the camshaft 22 can be used.

Figure 4:
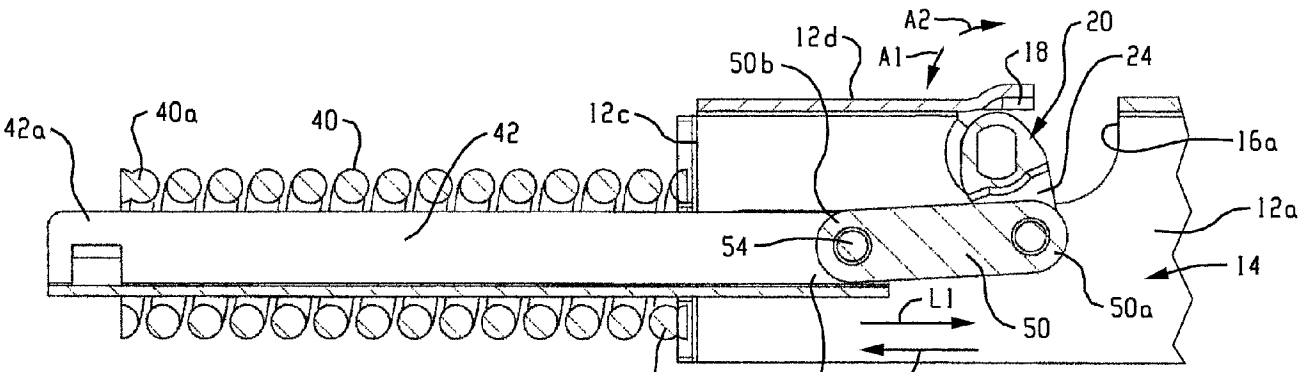
FIG. 4 is a section view as taken along view line 4-4 of FIG. 3.

The counterbalance assembly 10 further includes a biasing spring 40 operatively connected/coupled to the rotating cam 20 for controlling rotational movement of the cam. In the illustrated embodiment, the spring 40 is a helical coil spring having an outer end 40*a* spaced from the base face wall 12*c*, external to the channel 14, and an opposite inner end 40*b* operably abutted or otherwise engaged with the face wall 12*c* or other part of the base 12 (via direct abutment or indirect abutment through a thrust washer or the like). A spring rod 42 extends coaxially through the spring 40, and an outer end 42*a* of the spring rod is operatively engaged/coupled to the outer end of the spring 40*a*, e.g., by deforming the outer end 42*a* of the spring rod and/or by including a washer or other enlarged member or portion on the outer end 42*a* of the spring rod 42, so that the outer end 42*a* cannot pass through the hollow core region or inside diameter of the spring 40. The spring rod 42 also extends through an opening in the face wall 12*c* of the base 12 such that an inner end 42*b* of the spring rod is located in the channel 14. The inner end 42*b* of the spring rod is operatively coupled to the rotating cam 20 through a connecting link 50. As shown in FIG. 4, rotation of the cam 20 about its axis X in first and second angular directions A1, A2 results in corresponding linear translation of the spring rod in corresponding first and second linear directions L1, L2.

Figure 3:
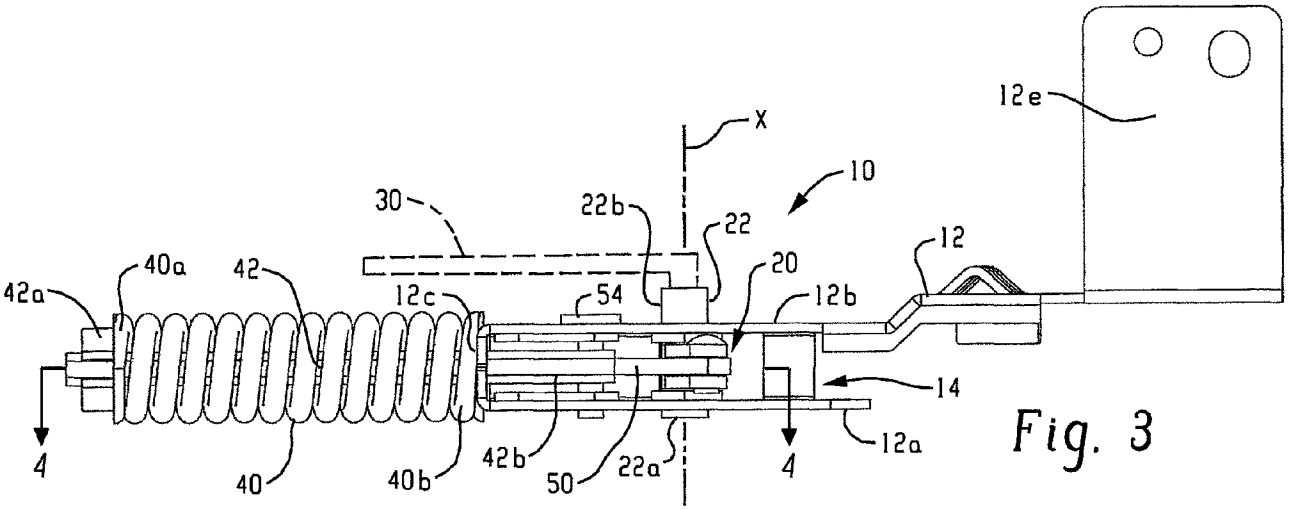
FIG. 3 is a bottom view of the counterbalance assembly of FIGS. 1 and 2.

With continuing reference to FIGS. 3 and 4, the rotating cam 20 includes a radially projecting tab or lobe 24 located in the channel 14 between the base side walls 12*a*, 12*b*. The inner end 42*b* of the spring rod 42 is operatively coupled to the lobe 24 of the cam 20 by the connecting link 50 that has a first end 50*a* pivotally connected to the cam lobe 24 a second end 50*b* pivotally connected to the inner end 42*b* of the spring rod 42. The pivoting connections between the connecting link 50 and the arm 24 and spring rod 42 can be made using rivets or other fasteners or by other means such as direct engagement between mating portions of the components. The spring 40 biases the spring rod 42 to an extended position in which the outer end 42*a* of the spring rod 42 is spaced a maximum distance from the face wall 12*c* of the base 12.

Figure 4A:
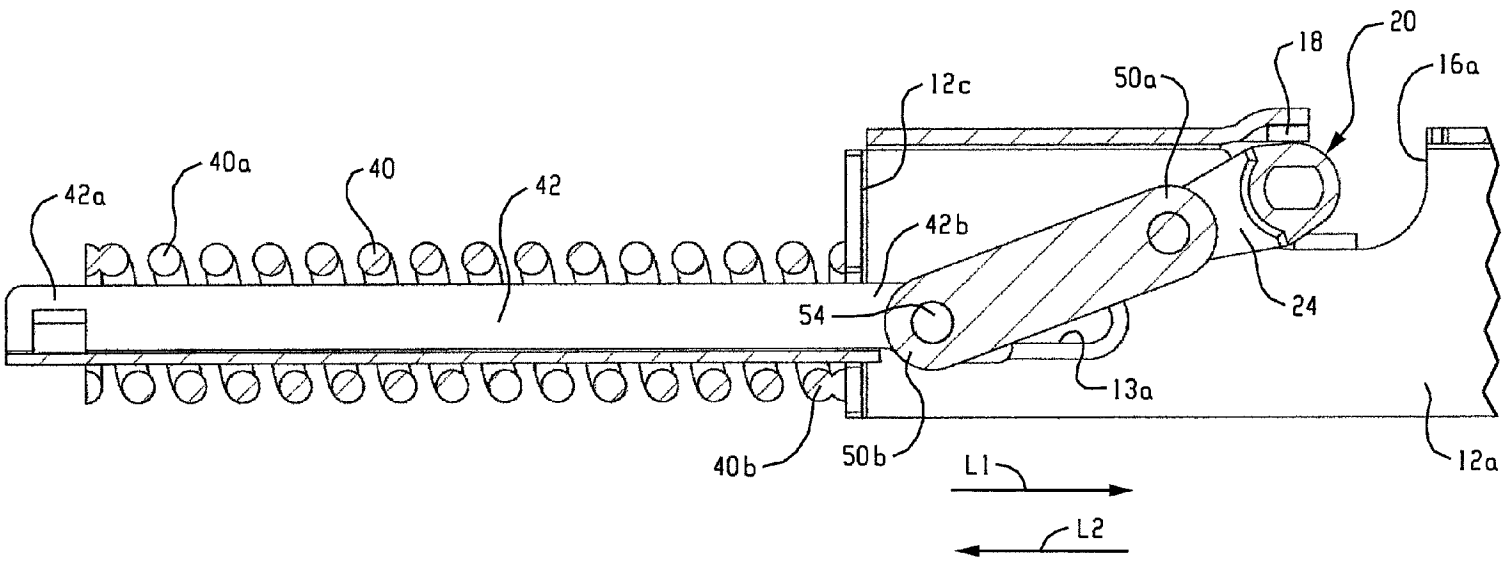
FIG. 4A is similar to FIG. 4 but shows the counterbalance assembly in a second operative position corresponding to the appliance lid/door being opened.

Referring to FIGS. 4 and 4A, rotational movement of the cam 20 about its longitudinal axis X in the first angular direction A1 (in response to closing movement of the appliance lid/door to which the mounting hinge arm 30 is connected) will induce inward sliding translation of the spring rod 42 in the direction L1 into the channel 14 against the biasing force of the spring 40 so that the outer end 42*a* of the spring rod 42 is moved toward the transverse wall 12*c* and compresses the coils of spring 40, which corresponds to a first operative position of the counterbalance assembly 10 as shown in FIG. 4. Rotational movement of the cam 20 in an opposite angular direction A2 during opening of the appliance lid/door to which the lid/door mounting hinge arm 30 is connected will be aided by the resilient biasing force of the spring 40 which assists sliding translational movement of the spring rod 42 in the direction L2 to its extended position where the outer end 42*a* of the spring rod is spaced a maximum distance from the transverse wall 12*c*, which corresponds to a second operative position of the counterbalance assembly 10 as shown in FIG. 4A. As such, the resilient elongation of the spring 40 assists opening movement of the associated appliance lid/door connected to the hinge arm 30 and the resilient compression of the spring 40 dampens closing movement of the associated lid/door.

In the illustrated embodiment, the inner end 42*b* of the spring rod is pivotally connected to the end 50*b* of the connecting link 50 by a rivet or other pivot fastener 54. The first and second body side walls 12*a*, 12*b* include respective first and second elongated slots 13*a*, 13*b* that are aligned with each other, and the pivot fastener 54 is slidably engaged in at least one and preferably both of the slots 13*a*, 13*b*. As shown, the pivot fastener 54 includes opposite first and second ends that are respectively slidably engaged with the first and second elongated slots 13*a*, 13*b*. The sliding engagement of the fastener 54 in the slots 13*a*, 13*b* serves to stabilize and control movement of the spring rod 42 and cam 20 and limits the maximum inward and outward sliding movement of the spring rod 42 in the directions L1 and L2 (and thus limits the angular rotation of the cam 20 in the directions A1 and A2).

Figure 5:
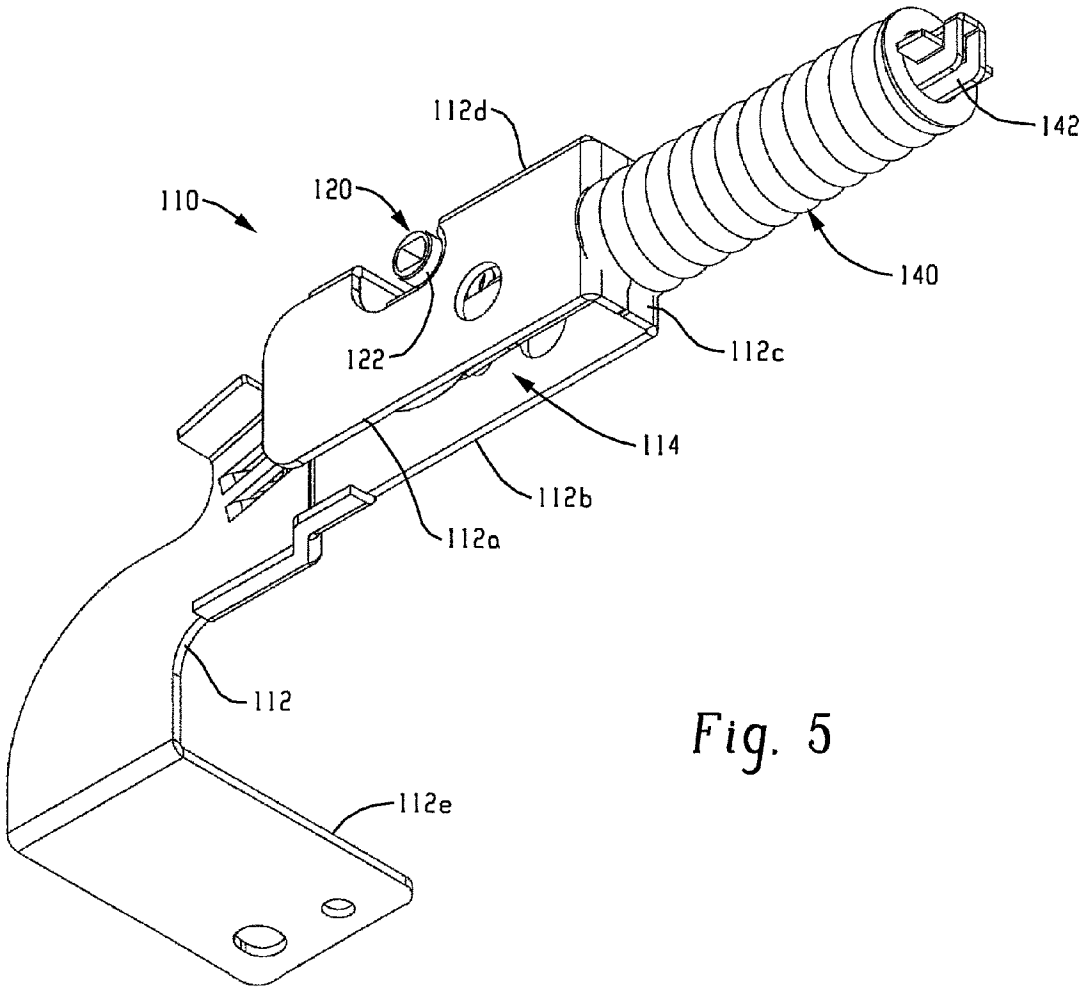
FIG. 5 is an isometric view similar to FIG. 2, but showing an alternative embodiment of an appliance hinge counterbalance assembly in accordance with another aspect of the present disclosure.
Figure 6:
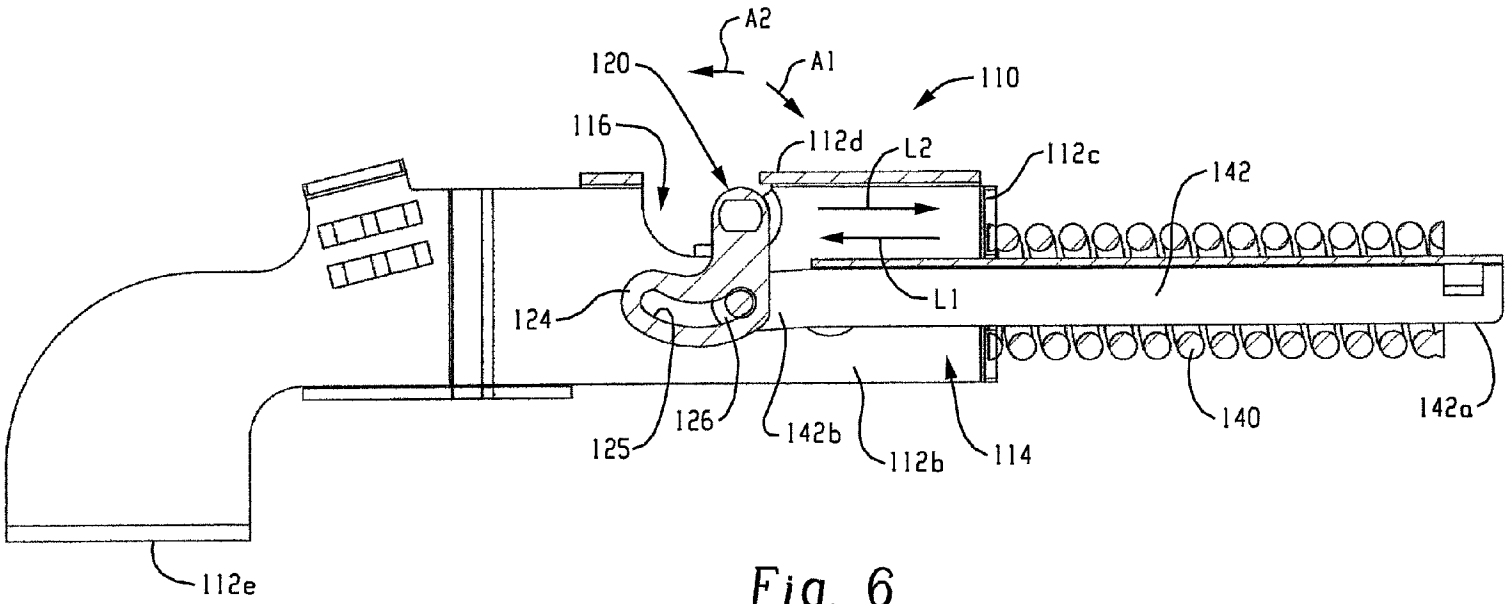
FIG. 6 is a section view taken at line 6-6 of FIG. 5.
Figure 6A:
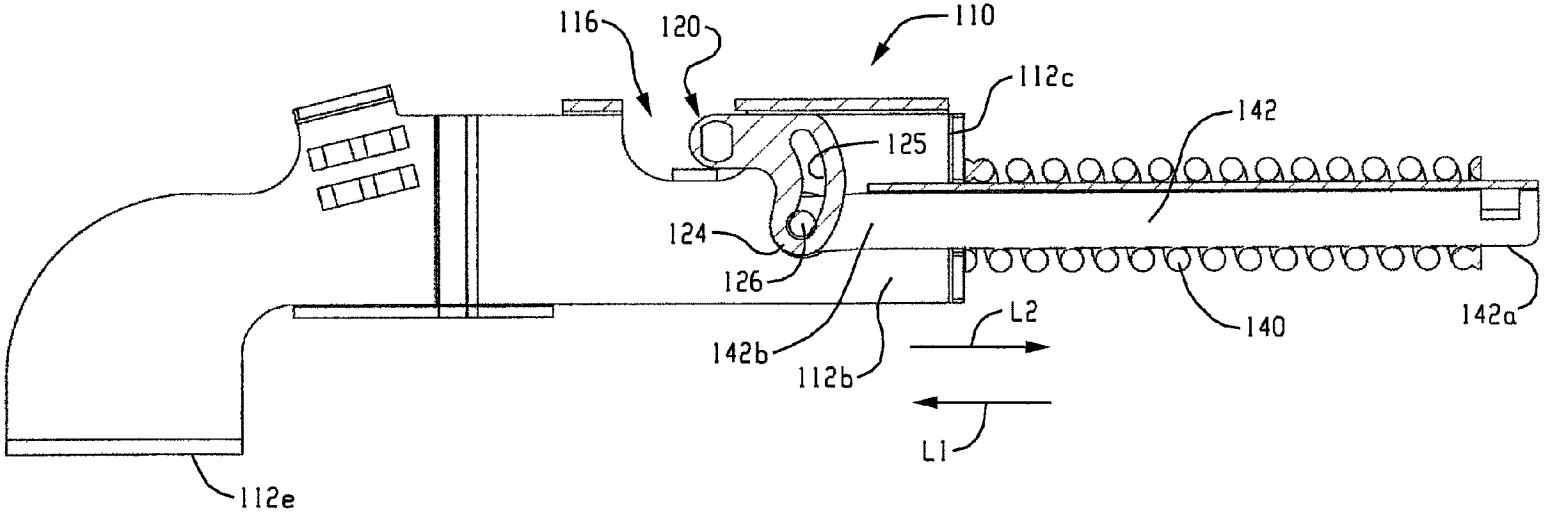
FIG. 6A is similar to FIG. 6 but shows the counterbalance assembly in a second operative position corresponding to the appliance lid/door being opened.

FIGS. 5, 6 and 6A illustrate and alternative embodiment counterbalance assembly 110 that is the same as the counterbalance assembly 10 except as otherwise shown and/or described herein. As such, like components are identified with like reference numbers that are 100 greater than those used above in relation to FIGS. 1-4 and are not all described further here. In the counterbalance assembly 110, the lobe 124 of the cam 120 includes an elongated curved or arcuate slot 125, and the inner end 142*b* of the spring rod 142 is directly slidably connected to the lobe 124 with a sliding engagement between the spring rod inner end 142*b* and the slot 125, e.g., using a rivet 126 or other slide fastener. The slots 13*a*, 13*b* of the base 12 from FIGS. 1-4 are not required because the elongated arcuate slot 125 of the cam lobe 124 limits travel of the spring rod 142 in the directions L1, L2. FIG. 6 shows a first operative position of the counterbalance assembly 110, which corresponds to the appliance lid/door being closed. FIG. 6A shows a second operative position of the counterbalance assembly 110, which corresponds to the appliance lid/door being opened.

FIGS. 7-16 illustrate another alternate embodiment counterbalance assembly 210 that is similar to the counterbalance assembly 10 except as otherwise shown and/or described herein. As such, like components are identified with like reference numbers that are 200 greater than those used in FIGS. 1-4A and are not all further described in detail here.

Figure 7:
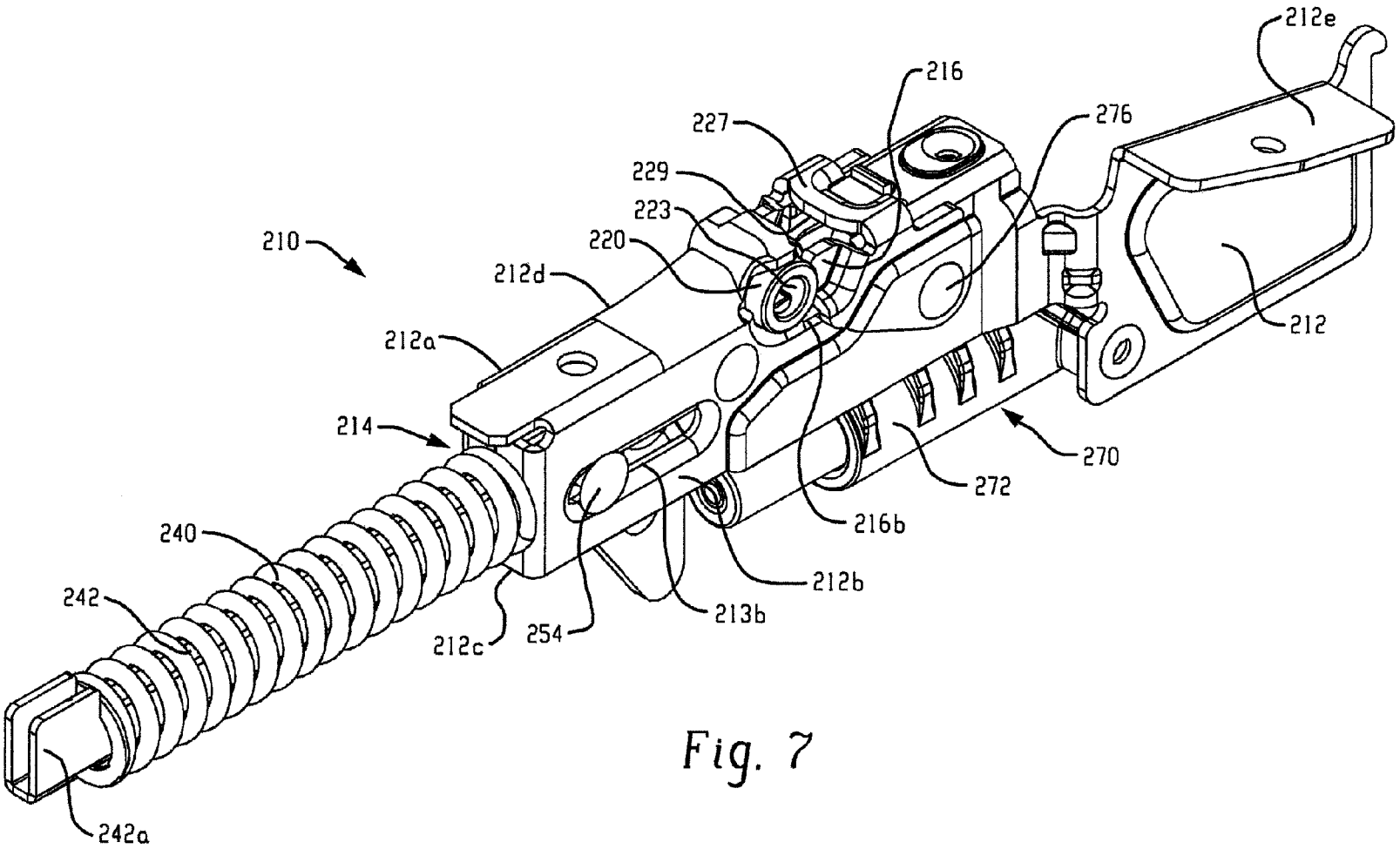
FIGS. 7 and 8 are first and second isometric views of an appliance hinge counterbalance assembly formed in accordance with a second aspect of the disclosure including a snubber damping assembly corresponding to a lid/door of the appliance in an opened position.
Figure 8:
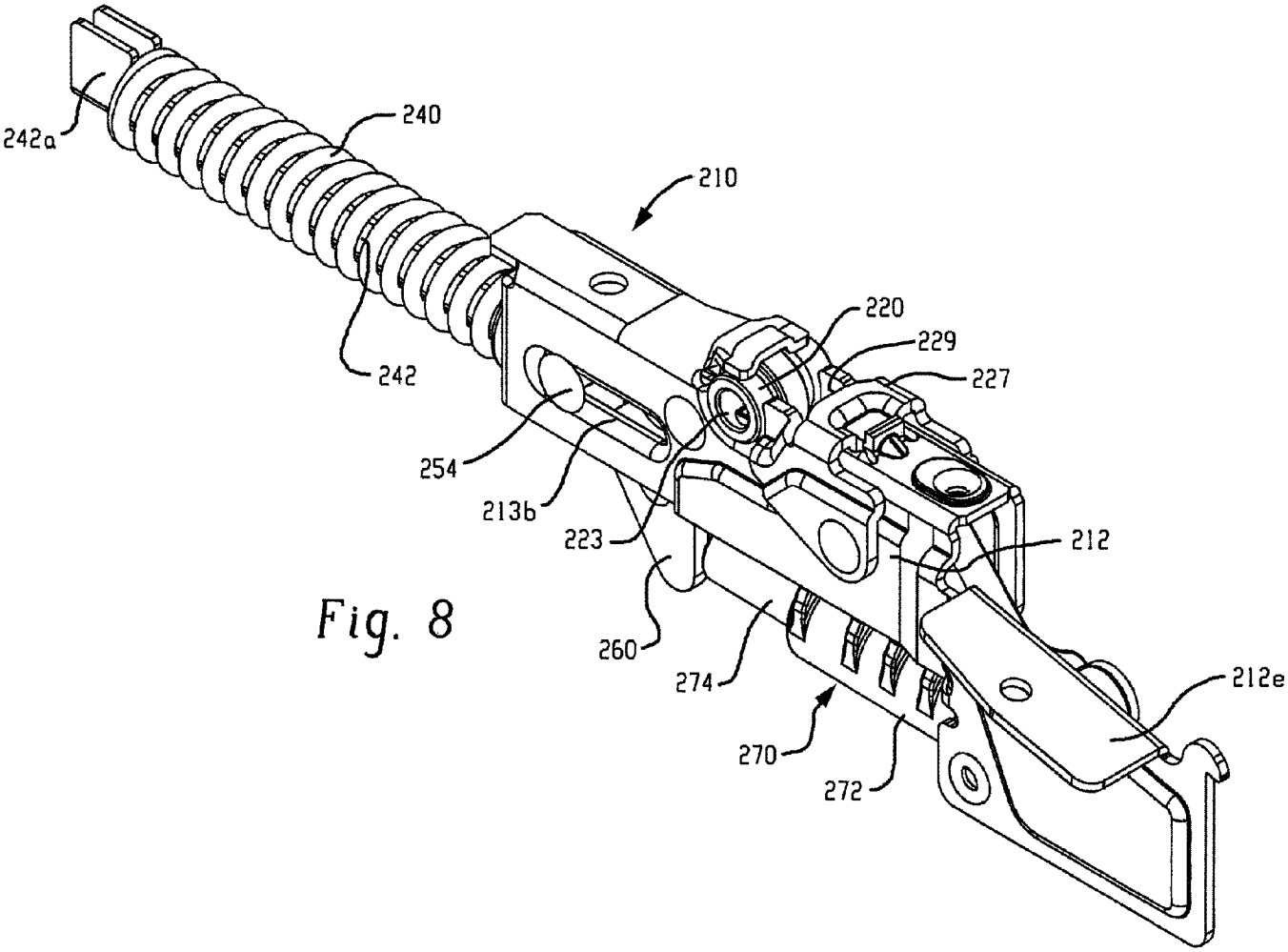
Figure 9:
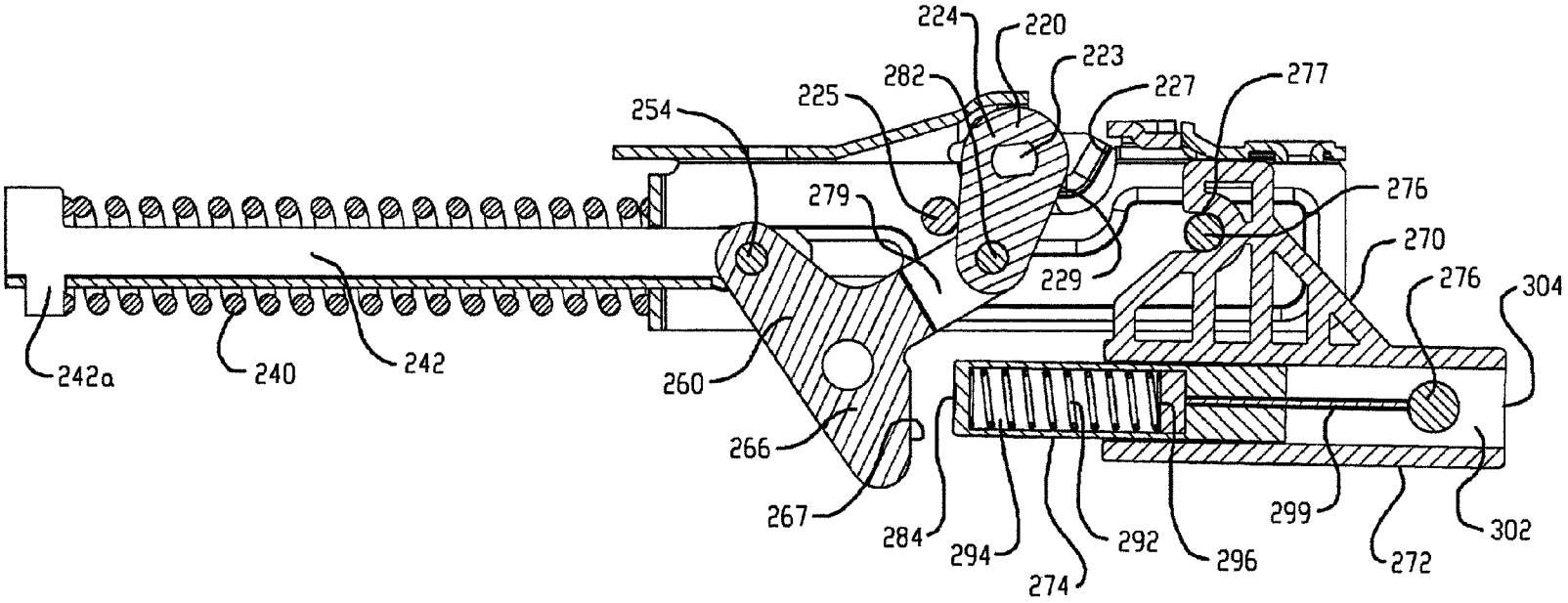
FIG. 9 is a cross-sectional view of the counterbalance of FIGS. 7 and 8.
Figure 10:
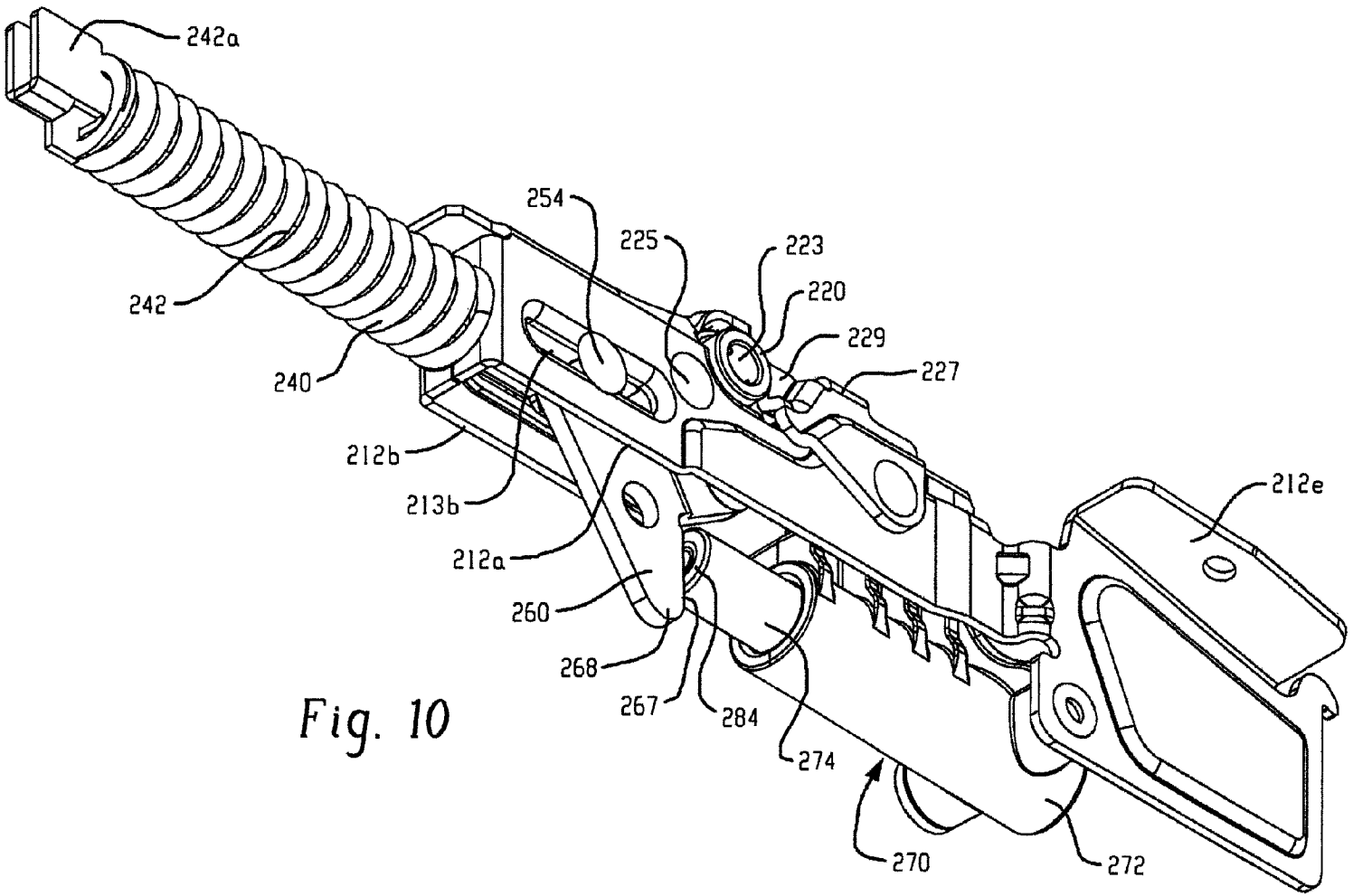
FIGS. 10 and 11 are isometric views of the counterbalance with a snubber corresponding to a slow close engagement position of the lid/door.
Figure 11:
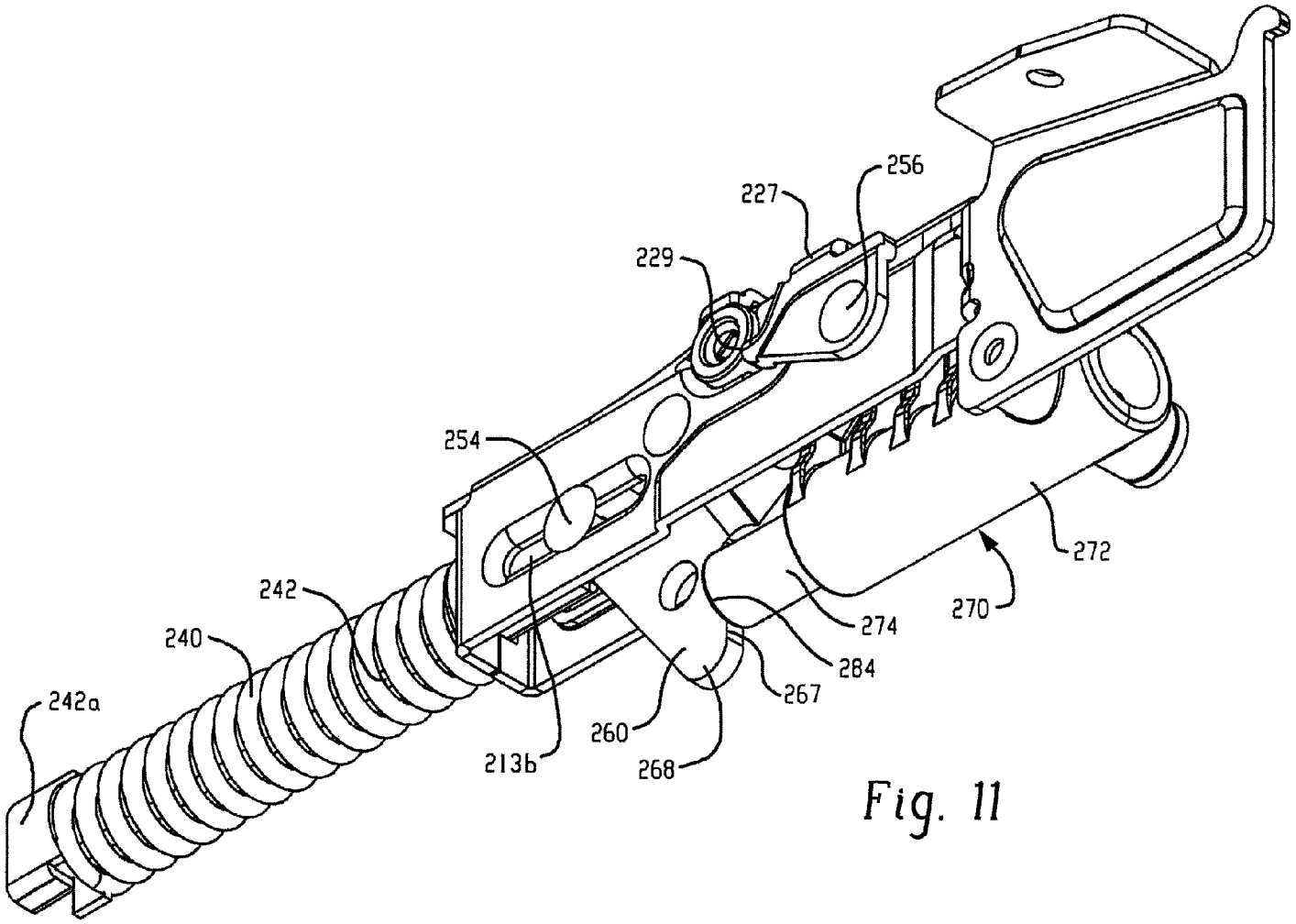
Figure 12:
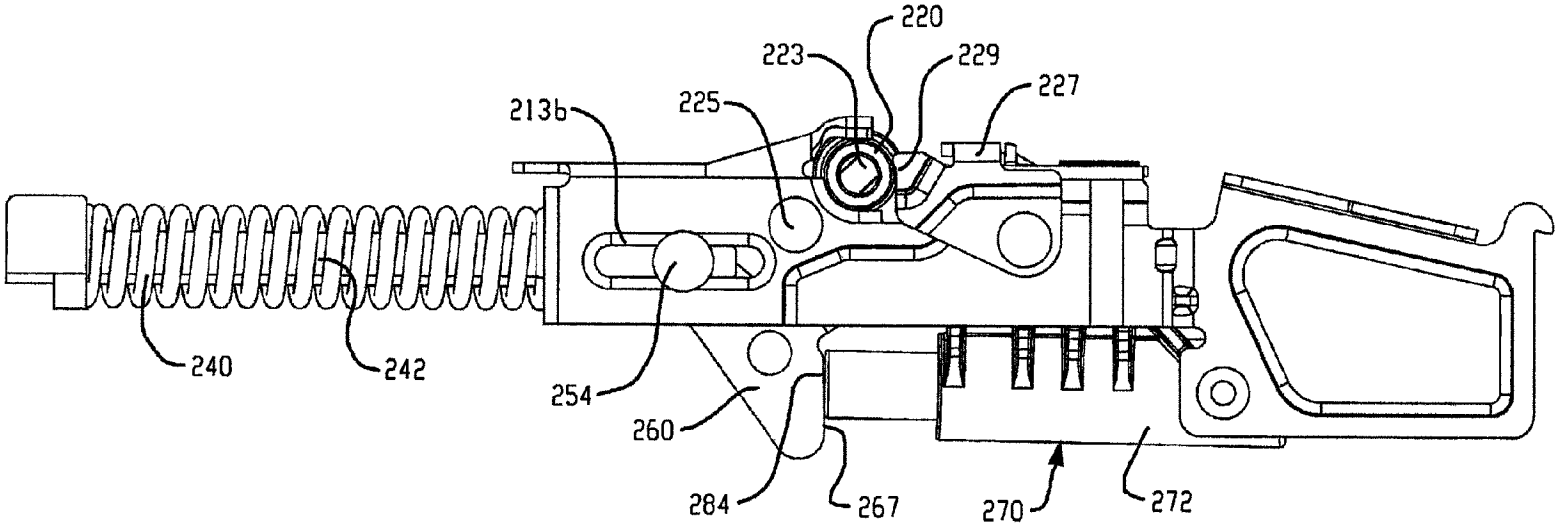
FIG. 12 is a side elevational view of the counterbalance assembly of FIGS. 10 and 11.
Figure 13:
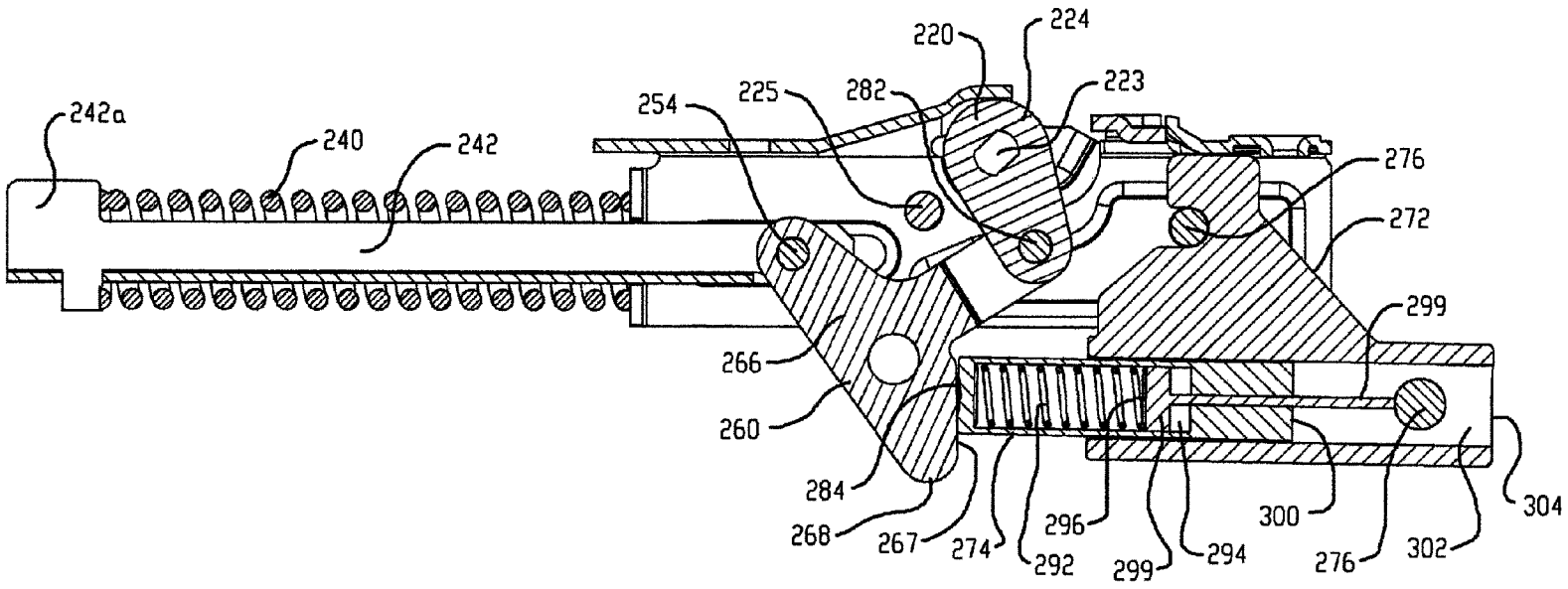
FIG. 13 is a cross-sectional view of the counterbalance of FIGS. 10, 11, and 12.
Figure 14:
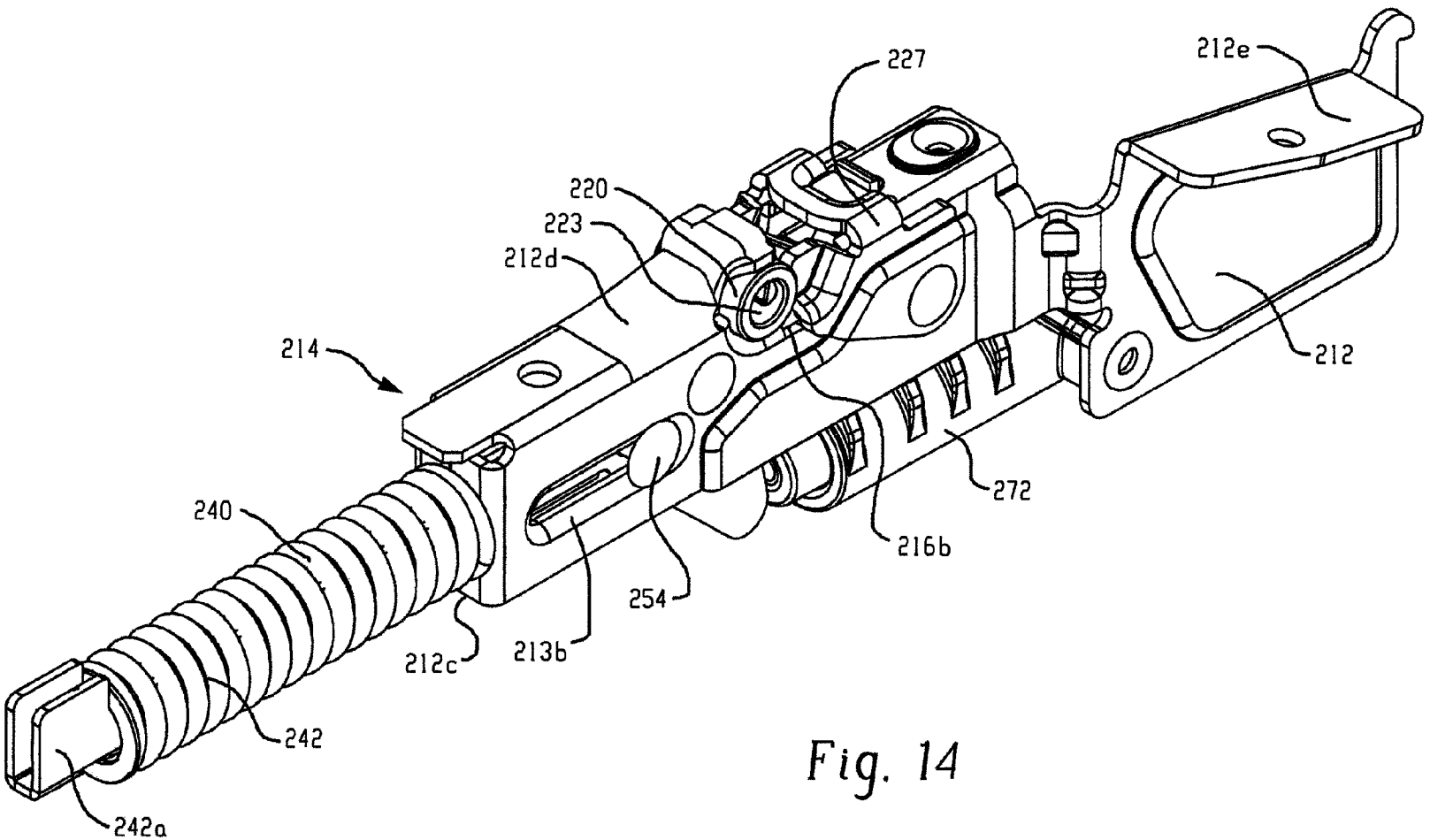
FIGS. 14 and 15 are isometric views of the counterbalance with a snubber corresponding to a lid/door in a closed position.
Figure 15:
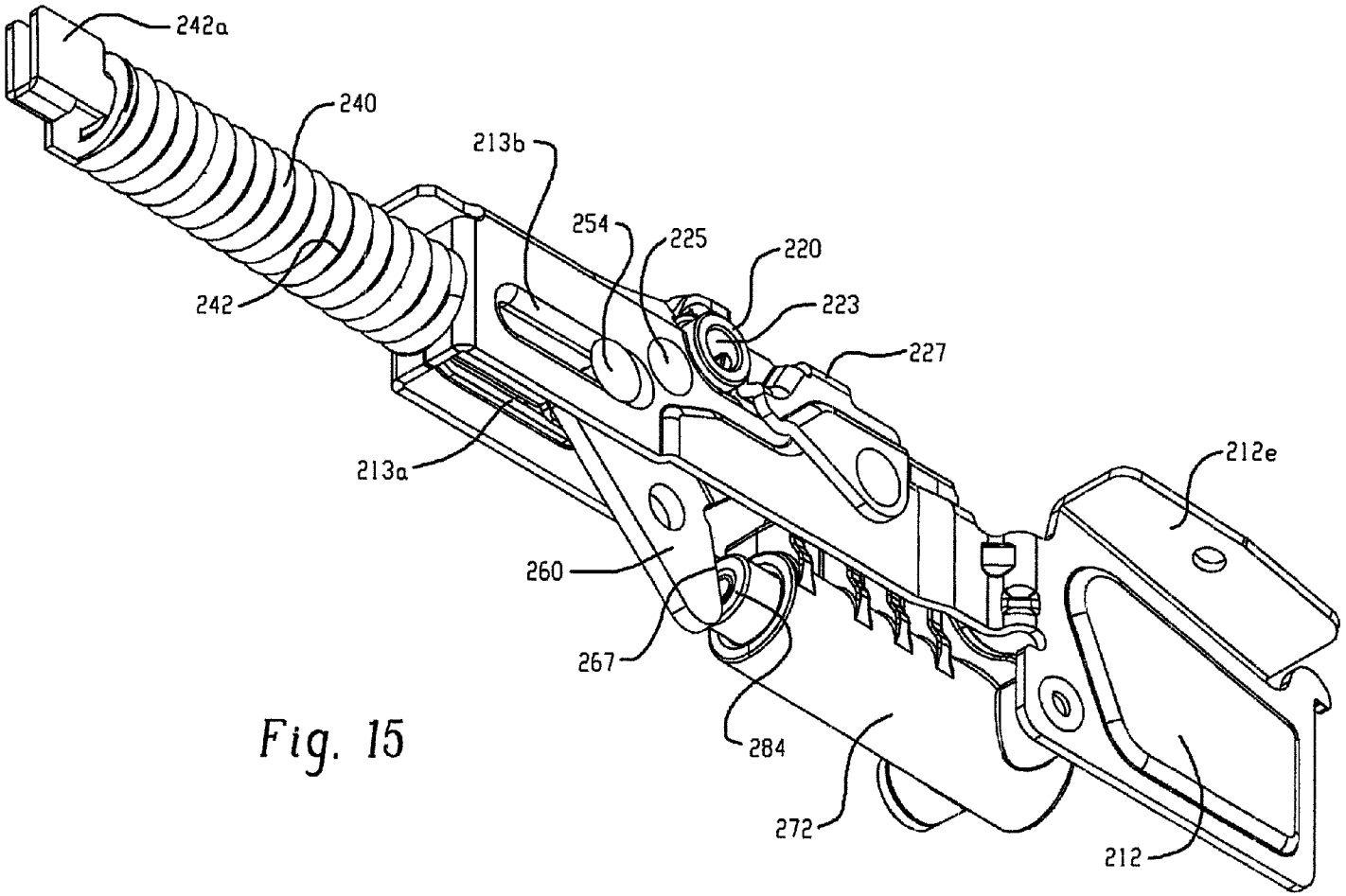
Figure 16:
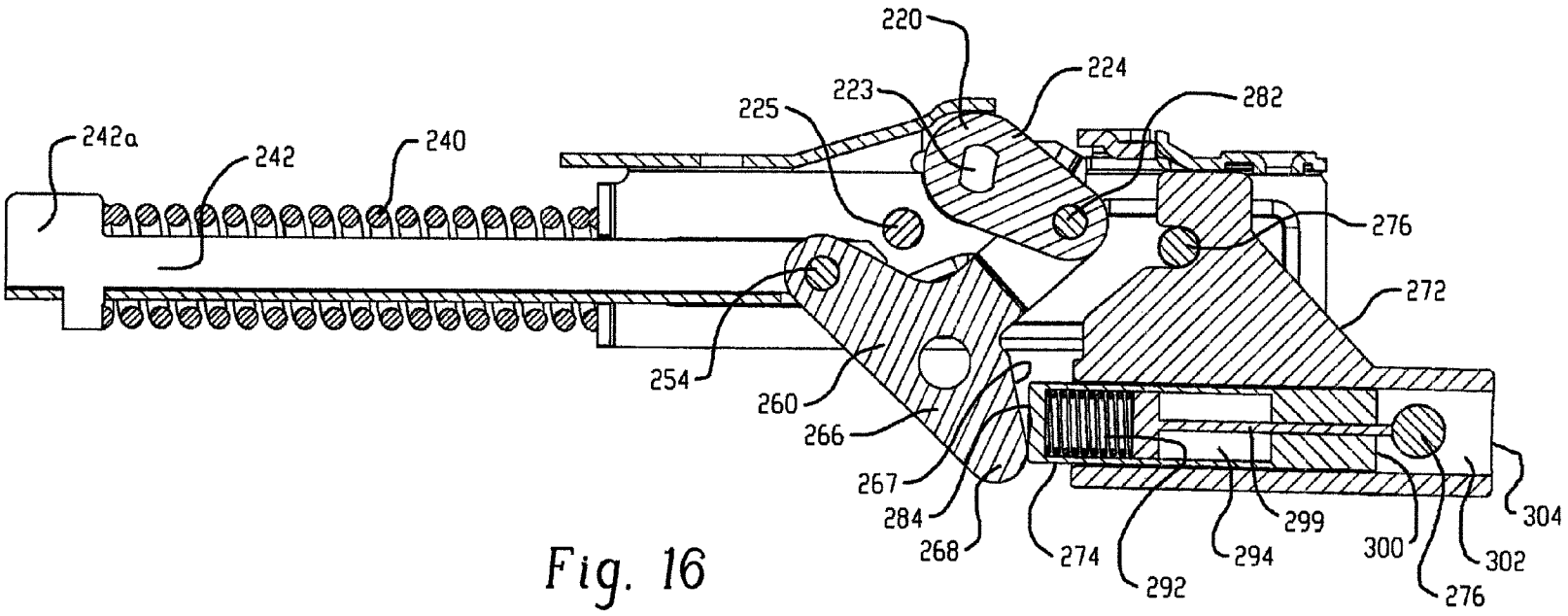
FIG. 16 is a cross-sectional view of the counterbalance of FIGS. 14 and 15.

As shown in FIGS. 7-16, counterbalance assembly 210 further comprises a snubber or damping assembly 270 in accordance with another aspect of the disclosure. In FIGS. 7-9, the snubber assembly 270 is shown in a position corresponding to an opened lid position. FIGS. 10-13 illustrate the snubber in the initial slow close engagement position, while FIGS. 14-16 illustrate the snubber in a position corresponding to a lid fully closed position.

A snubber is typically a mechanical device which allows for movement in tension and compression while acting as a damper to absorb dynamic energy and transfer it to the supporting structure. The snubber 270 preferably comprises a housing 272 and a piston assembly 274 that extends and retracts relative to the housing 272. Preferably, the piston assembly 274 is a fluid (liquid or gas) damper. The snubber or damper housing 272 can be fabricated of thermoplastic or other suitable material which is riveted or otherwise fastened onto channel base 212. Rivets such as shoulder rivet 276 can be used to fasten the housing 272 to the base. A channel or groove or recess 277 is formed in the housing to accommodate the rivet 276 and to attach and fasten the snubber housing. However, any suitable means or configuration for fastening the snubber housing to the base is also contemplated by the disclosure.

The piston assembly includes an internal piston spring 292 such as a helical coil spring and internal fluid (such as oil, gas or air) within an internal opening or chamber 294 of the piston assembly. The internal spring 292 biases the piston 274 toward its extended position shown in FIGS. 7-9. An outer end of the piston spring 292 is engaged with an outer transverse face wall 284 of the piston 274. An inner end of the spring 292 is engaged with an inner wall 296 of piston rod 299 disposed within opening 302 of the damper assembly housing 272. The piston spring 292 is shown in FIGS. 7-9 in its fully extended position corresponding to the lid opened position. The spring 292 also biases the piston 274 to its fully extended position as shown in FIG. 9.

During assembly, piston assembly 274 is inserted into opening 302 of the damper housing by first inserting rod 299 into opening 302 until a first end of the rod 299 contacts or abuts one of the shoulder rivets 276 positioned within and through the housing 272. A second opposite end of the rod 299 extends through an opening formed through end wall 300 of piston 274. Piston 274 remains biased to its extended position by spring 292 which extends between opposite walls 284 of the piston and 296 of the piston rod.

Pivot fastener 254 of a lever 260 is slidably engaged within the slots 213*a*, 213*b* of the base that constrain the fastener's movement to a reciprocal linear path within the slots. Engagement lever or tab or link 260 is attached to the spring rod 242 via pin or pivot fastener 254 which slides along slots or grooves 213*a*, 213*b* formed on opposite sides of the channel housing or base. The link 260 also moves in a linear path as the pivot fastener 254 slides within slots 213*a*, 213*b*. However, the link 260 can also pivot or rotate slightly as seen in FIGS. 13 and 16 when the link is pushing piston 274. The link 260 further has a first portion or tab 266 which extends downwardly from the channel and forms a stopper or a ledge 267 on a lower edge 268 of the first portion 266. Ledge 267 contacts outer end 284 of piston 274 of the snubber and pushes the piston 274 into internal opening 302 formed within the snubber housing 272. The link 260 has a second link portion 279 which can be offset to accommodate the spring rod 242 within the channel. Lobe 224 of cam 220 is pivotally connected to second portion 279 via a pivot pin 282. Lobe 224 preferably has a recess 223 which may be circular or non-circular corresponds to cam 220.

As lobe 224 rotates or pivots clockwise from a closed position (FIGS. 14-16) to an opened position (FIGS. 7-9), a portion of the lobe 224 contacts stop pin or rivet or member 225 mounted to the base (see FIG. 9) which acts as a full open stop to prevent the lid from opening too far and contacting the control panel of the appliance. A clip 227, such as a metal clip, is snapped, mounted or otherwise fastened to the upper surface of the base and has a tip or edge 229 (FIG. 9) which also contacts the lobe 224 such that once the lobe 224 engages the stop rivet 225, the clip tip 229 prevents the lobe from camming, rotating or pivoting about the stop rivet 225 and is held or retained in its operative open position.

Referring now to FIGS. 10-13, the snubber assembly is shown in position corresponding to a lid slow close engagement position. The rod 242 is gradually moved or slid towards the channel body 212, while the link 260 is also moved towards the channel body as a result of pin 254 sliding within elongated slots or grooves 213*a*, 213*b*. During the sliding motion of the link 260, the ledge or stopper edge 267 moves into initial contact or engagement with outer face wall 284 of the piston 274 as shown in the position illustrated in in FIGS. 10-13. Link 260 may also rotate or pivot slightly towards the piston as illustrated in FIGS. 13 and 16. Alternately, the link 260 may rotate or pivot in place without any translational or sliding movement.

Within the piston 274 is helical coil spring 292 which is positioned within cavity or opening 294 formed in the piston body which biases the end of the piston to an external position outside of the snubber/damper housing 272. As the link 260 pushes on the external piston wall 284, the piston moves or slides inwardly along and over rod 299 until the closed position is reached (see FIGS. 14-16). The spring 292 and fluid within the piston (such as oil, gas or air) becomes compressed between piston wall 284 and piston rod wall 296 thereby damping movement of the lid/door hinge.

Referring now to FIGS. 14-16, the snubber assembly is shown in a position corresponding to the lid/door fully closed position. Rotational movement of cam 220 about its longitudinal axis in a second angular direction (i.e., in response to closing movement of the appliance lid/door) induces inward sliding translation of spring rod 242 into channel 214 against the biasing force of the spring 240 so that the outer end 242*a* of the spring rod 242 is moved toward the outer transverse wall 212*c* and compresses the coils of spring 240, which corresponds to a first operative (closed) position of the counterbalance assembly 210 as shown in FIGS. 14-16. Similarly, lever 260 is moved further towards the piston 274 by sliding translational movement of pin 254 within slots 213*a*, 213*b*, thus pushing the piston 274 further into opening 302 of housing 272.

Referring to FIG. 16, in the fully closed lid position, the piston 274 is pushed into a fully inserted position within the snubber housing 272 until the spring 292 becomes almost fully compressed against inner wall 296 of the piston rod 299 and the air or fluid within the piston is compressed between walls 284 and 296. That is, inner wall 284 of piston 274 pushes or compresses air within opening 294 of the piston formed between wall 284 and wall 296 thus providing damping of the movement of the lid/door hinge.

Other variations on the damper assembly may include conventional mechanical springs, gas springs, fluid springs or elastomeric material, such as a compressible rubber member, etc. Also, a second damper assembly can be added to an opposite end of the hinge assembly if further damper is needed or required. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A counterbalance assembly for an appliance hinge, said counterbalance assembly comprising:

a base including first and second spaced-apart side walls and a transverse face wall, said base including: (i) a channel located between the first and second side walls; and, (ii) first and second notch portions respectively located in said first and second side walls;

a rotating cam supported on the base, said cam including: (i) a camshaft that extends between the side walls and that is adapted for rotation about an axis of rotation, said camshaft comprising a first end located in said first notch portion and a second end located in said second notch portion; and (ii) a lobe that projects from the camshaft;

a biasing spring comprising an inner end engaged with the base and an outer end spaced from the base, said outer end of said spring located outside said channel;

a spring rod including an outer end operatively coupled to the spring and an inner end operatively coupled to the lobe of the cam such that said spring biases said spring rod to an extended position;

a damper assembly comprising a lever operably connected to said spring rod and a piston assembly connected to said base and comprising a piston which is moved between a first position and a second position by said lever contacting said piston;

wherein said lever is pivotally connected to said spring rod via a pivot fastener that is slidably engaged within the base;

wherein rotational movement of the cam in a first angular direction causes inward sliding movement of the lever and pivot fastener in a first direction; and rotational movement of the cam in a second angular direction corresponds to outward sliding movement of the lever and pivot fastener in a second direction;

wherein said lever is operatively connected to a lobe of the cam by a connecting link, said connecting link including a first end pivotally connected to the cam lobe and a second end integrally connected to the lever;

wherein said base comprises a stop member wherein said cam lobe contacts said stop member when said cam rotates in said second angular direction, wherein said stop member prevents further movement of said lobe in said second angular direction; and wherein said base further comprises a clip mounted thereon, wherein when said cam lobe contacts said stop member, said clip prevents said lobe from rotating about said stop member and retains said lobe in its operative position.

2. The counterbalance assembly as set forth in claim 1, further comprising: a piston spring extending coaxially through an opening of said piston.

3. The counterbalance assembly as set forth in claim 2, wherein: said piston spring comprises a helical coil spring; an outer end of said piston spring is engaged with an outer transverse face wall of said piston; and an inner end of said spring piston is engaged with an inner wall of a piston rod disposed within a housing of said damper assembly.

4. The counterbalance assembly as set forth in claim 3, wherein: said piston is disposed within an opening formed in said damper assembly housing.

5. The counterbalance assembly as set forth in claim 4, wherein first and second elongated slots are defined in first and second sidewalls of the base, and said pivot fastener is slidably located in at least one of the first and second slots.

6. The counterbalance assembly as set forth in claim 5, wherein said pivot fastener comprises opposite first and second ends that are respectively located in said first and second elongated slots.

7. The counterbalance assembly as set forth in claim 6, wherein said lever comprises a ledge which abuts said outer transverse face wall of said piston.

8. The counterbalance assembly as set forth in claim 7, wherein movement of said lever in said first direction moves said ledge into contact with said outer transverse face wall of said piston which pushes said piston into said opening of said damper assembly housing.

9. The counterbalance assembly as set forth in claim 8, wherein as said piston moves into said opening of said damper assembly housing said piston compresses fluid located in said piston between an inner wall of said piston and an inner transverse wall of said piston rod.

10. The counterbalance assembly of claim 9, wherein said piston spring is compressed between said outer transverse face wall of said piston and said inner wall of said piston rod as said piston moves into said damper assembly housing.

11. The counterbalance assembly as set forth in claim 10, wherein outward sliding movement of the lever in a second position results in said piston extending to an outer extended position.

12. The counterbalance assembly as set forth in claim 11, wherein said piston extending to its extended position is aided by said piston spring becoming uncompressed.

* * * * *